US007290588B2

(12) United States Patent
Erhard et al.

(10) Patent No.: US 7,290,588 B2
(45) Date of Patent: Nov. 6, 2007

(54) PROTECTIVE GAS DEVICE FOR PRESSURE DIE-CASTING MACHINES

(75) Inventors: Norbert Erhard, Lorch (DE); Ulrich Schraegle, Remshalden (DE); Gerd Mentel, Forst (DE)

(73) Assignee: Oskar Frech GmbH & Co. KG, Schorndorf (DE)

( * ) Notice: Subject to any disclaimer, the term of this patent is extended or adjusted under 35 U.S.C. 154(b) by 123 days.

(21) Appl. No.: 10/529,080

(22) PCT Filed: Sep. 19, 2003

(86) PCT No.: PCT/EP03/10450

§ 371 (c)(1),
(2), (4) Date: Sep. 21, 2005

(87) PCT Pub. No.: WO2004/030849

PCT Pub. Date: Apr. 15, 2004

(65) Prior Publication Data

US 2006/0090874 A1 May 4, 2006

(30) Foreign Application Priority Data

Sep. 25, 2002 (EP) ..... 02021445

(51) Int. Cl.
*B22D 27/00* (2006.01)

(52) U.S. Cl. ..... 164/259; 164/154.1

(58) Field of Classification Search ..... 164/259, 164/154.1, 4.1, 66.1
See application file for complete search history.

(56) References Cited

U.S. PATENT DOCUMENTS 4,065,299 A * 12/1977 Roberts et al. ..... 419/66
4,846,402 A * 7/1989 Sandell et al. ..... 239/9
5,205,346 A 4/1993 Kuhn et al.
5,388,633 A * 2/1995 Mercer, II et al. ..... 164/457
5,540,077 A * 7/1996 Benning et al. ..... 73/1.05
6,742,568 B2 * 6/2004 Meyer ..... 164/119

FOREIGN PATENT DOCUMENTS

| | | | |
|---|---|---|---|
| DE | 736 766 | C | 6/1943 |
| FR | 2 809 643 | A | 12/2001 |
| JP | 57 177871 | A | 11/1982 |
| JP | 03 258448 | A | 11/1991 |
| JP | 06 328227 | A | 11/1994 |
| WO | WO 99 02287 | A | 1/1999 |

* cited by examiner

*Primary Examiner*—Jonathan Johnson
*Assistant Examiner*—I.-H. Lin
(74) *Attorney, Agent, or Firm*—Crowell & Moring LLP

(57) ABSTRACT

A protective gas device for the melting furnaces of pressure die-casting machines, in particular for processing a magnesium melt. A collection container of a mixing device for the components of a protective gas, which covers the melt to prevent oxidation or other damage, is configured as a pressure accumulator and the orifices for feeding the protective gas into the melting furnace are provided with inlet nozzles. Gas flow to the inlet nozzles is regulated by metering devices. The operating pressure is equal to or less than the pressure in the pressure accumulator of the mixing device, but high enough to atomise the jets and produce a turbulent inflow behind the inlet nozzles. Said pressurized protective-gas distribution permits the metering of gas into various furnace chambers or furnaces without repercussions. A uniform concentration of the protective gas can be achieved in all areas by the selective arrangement of the inlet nozzles.

18 Claims, 4 Drawing Sheets

Fig 4
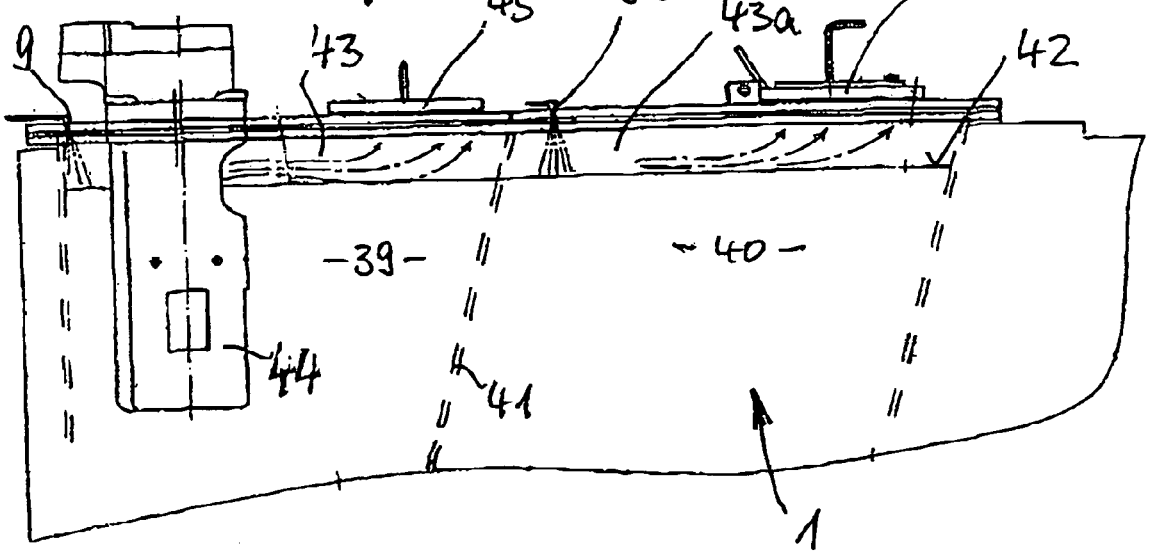
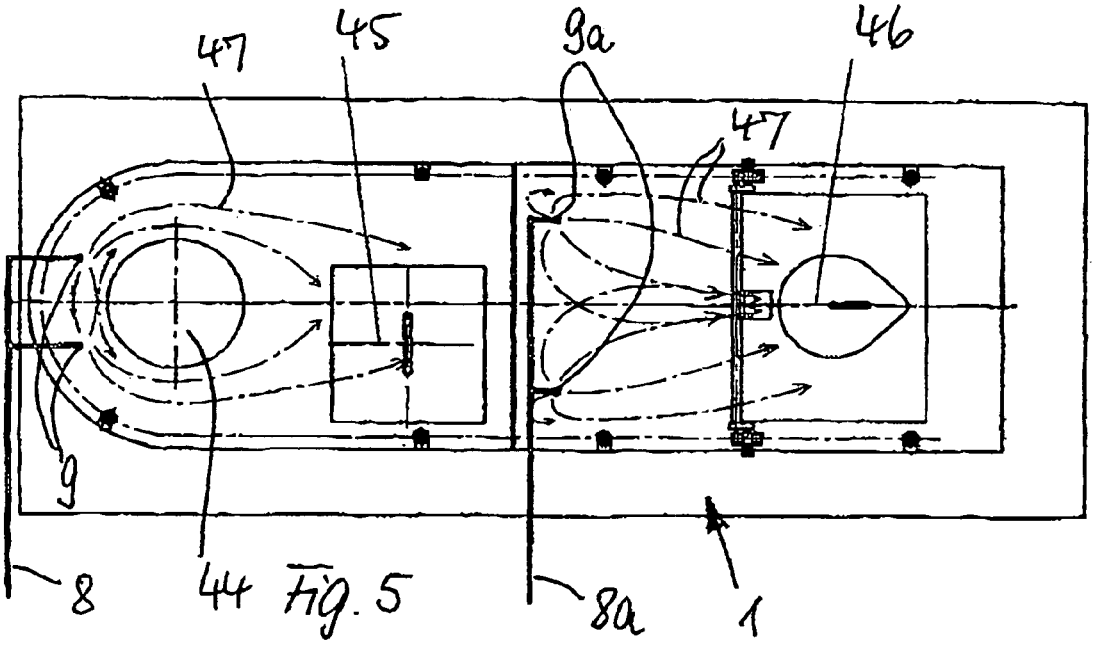
Fig. 5

PROTECTIVE GAS DEVICE FOR PRESSURE DIE-CASTING MACHINES

This is a National Phase Application based on PCT/EP2003/010450, filed Sep. 19, 2003 and claims the priority of German Application 020 21 445.8, filed Sep. 25, 2002 the disclosure of which is expressly incorporated by reference herein.

BACKGROUND AND SUMMARY OF THE INVENTION

The invention relates to a shielding gas device for pressure die-casting machines, in particular for processing magnesium melts, with a melting furnace having openings for supplying the shielding gases, and having various gas sources and a container situated downstream therefrom for receiving a mixture of the individual shielding gas components which is connected via at least one metering device to the openings in the melting furnace.

To prevent the reaction of magnesium with oxygen present in the air, the magnesium melts contained in the melting furnaces of pressure die-casting machines must be blanketed by an inert gas mixture. For this purpose, mixtures of carrier gases and sulfur hexafluoride ($SF_6$) or sulfur dioxide ($SO_2$) must be used, such as for example $N_2$ and $SF_6$, dry air and $SF_6$, or dry air and $SO_2$. The aim is to keep the concentration of the inert gas portion of the mixture as low as possible.

In the known devices for producing the inert gas mixture, the individual components are filled into a container by quantified feeding at relatively low pressure (0.8 to 1.5 bar), from which container the gas mixture is withdrawn and supplied to the melt surface.

In the devices currently known, the type of mixing process generally results in layering, or there is no assurance that layering does not occur. Layer formation may also occur when the gas has not been properly mixed and then settles due to gravity. A homogeneous mixture is not formed. When the gas is withdrawn, the resulting fluctuations in concentration influence the inert effect. An excessively low inert gas concentration results in combustion, while an excessively high concentration results in corrosion effects in the melting furnace and the casting unit, in addition to unnecessarily high pollutant emissions.

The gas mixture is supplied to the furnace through one or more inlet openings having the lowest possible flow resistance, the quantity to be metered being adjusted via the volumetric flow rate. If multiple inlet openings are connected to one metering unit, great variation in the metering results which is independent of the spacing between the openings.

If the inlet openings are combined as a group and connected to different metering devices, for one or more furnaces, for example, changes in the metering to one inlet opening affect the metering to the other inlet openings. Adjustment is very difficult as a rule. As a result, localized over- or undermetering in the furnace can also occur in this manner. Regions of $SF_6$ accumulation and areas of $SF_6$ depletion, referred to as concentration shadows, may appear above the melt in the furnace chamber. In the known designs, if a change in the metering is desired, such as for different operating modes (normal operation, cleaning, emergency mode), the adjustment must be determined and set in each case. The quantity of gases to be mixed must be adjusted to the respective operating state in a complicated procedure.

The object of the present invention, therefore, is to design a shielding gas device of the aforementioned type so that the shielding gas impinges on the melts in a simple and interference-free manner and the above-referenced problems are avoided. To achieve this object in a shielding gas device of the aforementioned type, it is provided that the container is a pressure accumulator, the openings in the melting furnace are supplied with inlet nozzles, and these inlet nozzles are impinged on by a metering device, the operating pressure of which is equal to or less than the pressure in the pressure accumulator, but in any case is high enough to atomize the shielding gas mixture downstream from the inlet nozzles.

In the embodiment of the invention, the metering process may be performed continuously or discontinuously, i.e., in a pulsating manner. In the latter case, for intermittent impingement of the inlet nozzle, small quantities may also be metered in a controlled manner without the risk that atomization then no longer occurs due to excessively low pressure. In order for atomization to take place in a system, it is known that two requirements must be met:

First, a certain pressure, and second, a certain volume are required by which a dynamic pressure is established by the nozzle. If the volume is so low that this dynamic pressure cannot be maintained, the atomization effect would also be absent. For this reason the metering device according to the invention is able to adjust the gas intermittently, i.e., in a pulsating manner, and therefore can further reduce the average quantity of gas introduced, although the system still functions in gassing mode. Mechanical adjustment of the nozzles themselves to this lowest-quantity metering is therefore not necessary.

This design achieves a rapid and uniform distribution over the melt so that concentration shadows or accumulations of shielding gas do not occur. In one refinement of the invention, the inlet nozzles are distributed on the melting furnace in such a way that gas flows to the leakage points that are present anyway, thereby ensuring a uniform concentration distribution. As used here, "leakage points" refers to all intended and unintended openings in the furnace, such as charge openings, cleaning openings, and actual sites of leaks, for example. The inlet nozzles are also configured in such a way that they are protected from contamination or plugging.

The operating pressure of the metering device, which is held constant, is adapted to the type of inlet nozzles, and thus also to the desired distribution principle of the gas mixture in the furnace. For this purpose, it is naturally advantageous to also monitor the inlet pressure at the metering unit, i.e., the pressure in the pressure accumulator, so that the operating pressure for the metering device can be maintained. If the pressure drops for any reason, the metering unit can be switched to emergency gassing via corresponding signals which also actuate optical displays, and the gas outlet can be opened.

As a result of regulating the operating pressure, the metering, i.e., the desired quantity of gas, is totally independent of other users of the same gas mixing unit. In this manner, different groups of inlet nozzles may be operated via multiple metering units without interference. Resetting the quantity supplied to one group of inlet nozzles does not affect the quantity supplied to the other group, and also has no influence on the mixture formation, i.e., the concentration of the shielding gas.

In this way, in the embodiment of the invention multiple metering devices may be connected in parallel, even for different furnaces, and fed by the pressure accumulator. Each metering unit may be provided with a device for adjusting the metered quantity, and in a simple manner an operating mode sensor is associated with each metering unit by which the operator can determine the metered quantity. In one refinement of the invention, each metering unit may also be provided with a control logic system that receives signals concerning the furnace status. The shielding gas concentration may also be automatically regulated in this manner.

In the embodiment of the invention, upstream from the pressure accumulator a mixing device having a mixing chamber is provided in which the gases forming the shielding gas mixture are combined under pressure. The system pressure in this mixing device may be coordinated with the operating pressure of the metering devices. The system pressure in the mixing device must be selected to be sufficiently higher than the operating pressure of the mixing devices.

In the embodiment of the invention, pressure nozzles for feeding the gases to be mixed may also be provided on the mixing chamber, whereby the feed lines to the mixing chamber are associated with respective pressure regulating devices, and it is also possible to provide pressure regulators for maintaining equal pressure to achieve balanced pressure regulation between the carrier gas and the shielding gas.

This embodiment has the advantage that the gases to be mixed, i.e., the components of the shielding gas, are provided in the mixing chamber under turbulent flow in the set mixing ratio, and are then fed to the pressure container. Gas mixing occurs without supplying electrical power. Thus, even in a power outage the precise mixture can be produced as long as sufficient quantities of gases to be mixed are available. The concentration is not changed thereby. Thus, the mixing device and metering device system is also able to maintain the precise concentration, even in a power outage. Only the metered quantity is based on fixed settings for continuously metered emergency gassing quantities. Emergency operation can be conducted in situations without power, which of course are indicated by signal devices.

As already mentioned, a mixing device with a pressure accumulator can supply multiple metering units which impinge on either different inlet nozzle groups on one furnace or on multiple furnaces, the metered quantities of which are independent of one another. Changing the operating state of one melting furnace, and thus making necessary changes to its metering, has no effect on the other melting furnaces.

As previously mentioned, the pressure in the pressure accumulator is monitored, and for this purpose a pressure monitoring device may be provided, for example in the connecting line between the mixing chamber and the pressure accumulator.

Lastly, in a further embodiment of the invention a gas analyzer may be associated with the mixing chamber, by which the concentration of the gas mixture may be monitored. This gas analyzer is able to compare the gas mixture in the mixing chamber to a reference gas mixture in a simple manner, and when there are deviations, to send a signal to the mixing device, thus enabling the feeding of gases to be mixed to be controlled.

Other objects, advantages and novel features of the present invention will become apparent from the following detailed description of the invention when considered in conjunction with the accompanying drawings.

BRIEF DESCRIPTION OF THE DRAWINGS

FIG. 4 shows a schematic longitudinal section through the melting furnace of FIG. 1;

FIG. 5 shows the top view of the melting furnace of FIG. 4; and

DETAILED DESCRIPTION

Figure 1:
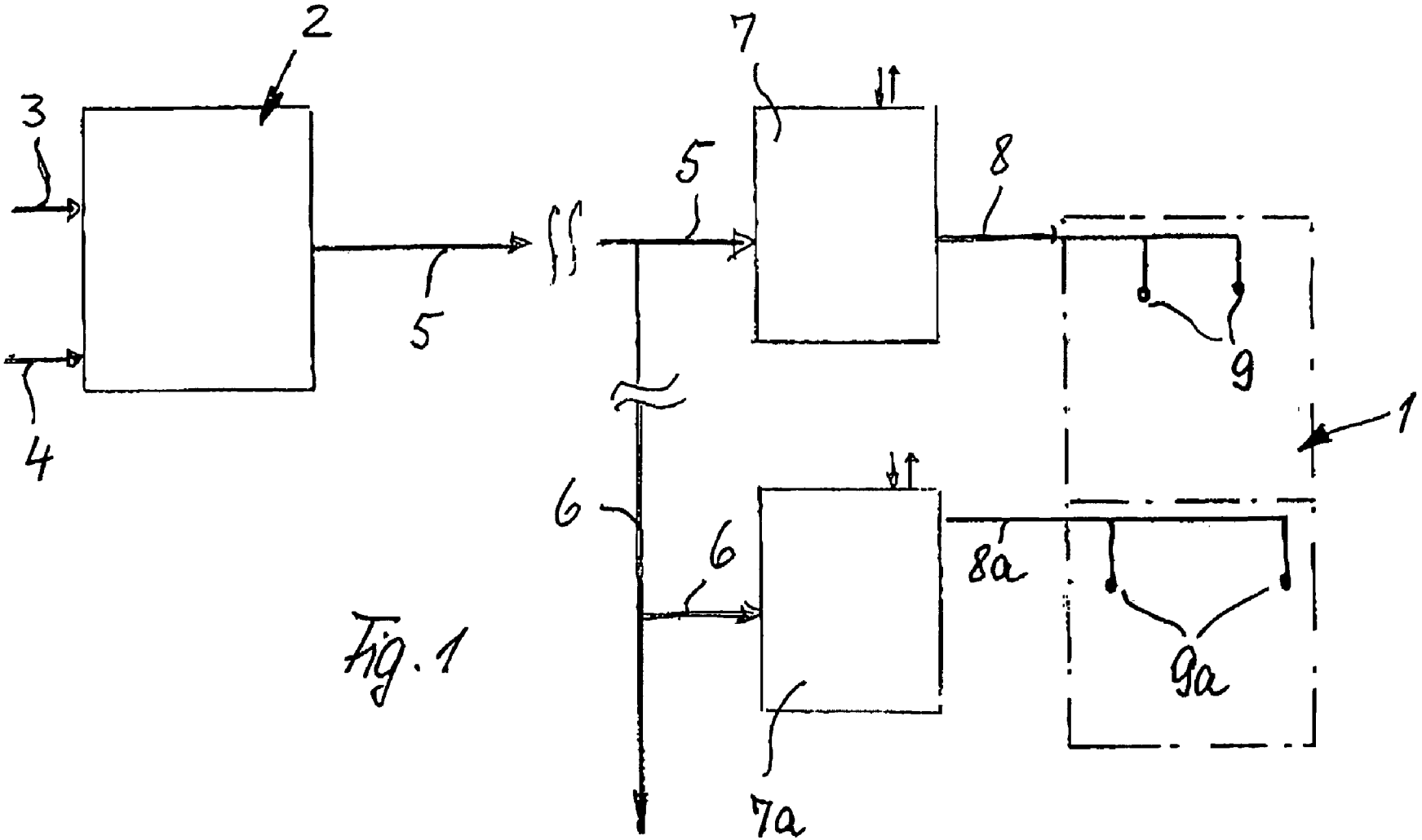
FIG. 1 shows a block diagram of a shielding gas device according to an embodiment of the invention.
Figure 2:
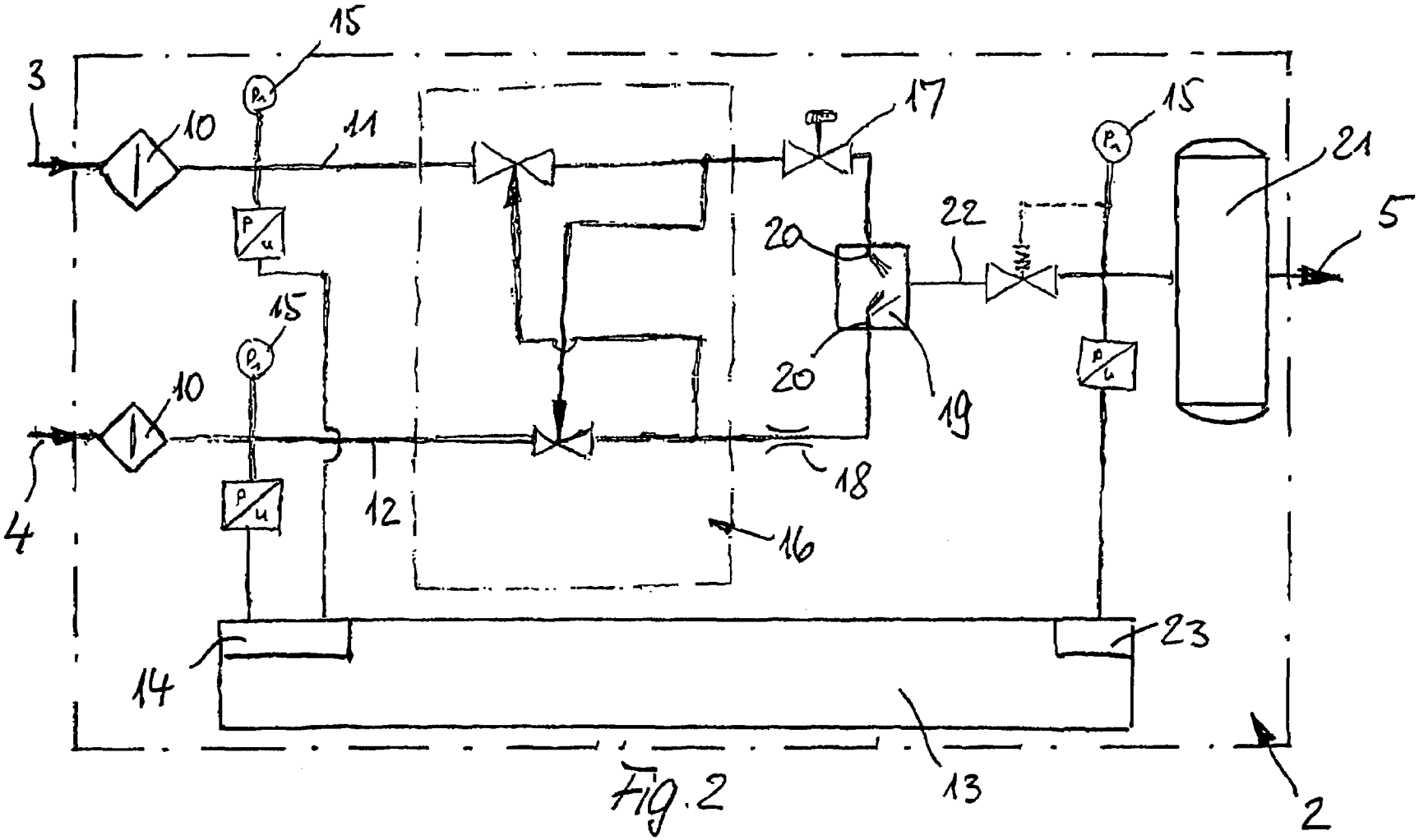
FIG. 2 shows the schematic illustration of the mixing device used in the shielding gas device of FIG. 1.

FIG. 1 shows a melting furnace 1, the outlines of which are indicated by dashed-dotted lines, the melt bath of which is to be blanketed with shielding gas. This melting furnace 1 is illustrated in detail in FIGS. 4 and 5, and is described at greater length in the discussion of those figures. The gas mixing and metering unit provided for impinging the melting furnace 1 with shielding gas comprises primarily a gas mixing unit 2, the design of which is illustrated in FIG. 2. The shielding gas used, i.e., $SF_6$ or $SO_2$, as indicated by arrow 3, and a carrier gas, for example $N_2$, as indicated by arrow 4, are fed to this gas mixing unit. Admixture of these two components occurs under pressure, to be explained in detail below with reference to FIG. 2. The shielding gas mixture thus formed is then held in a pressure accumulator inside the gas mixing unit, and from there shielding gas is fed via connecting lines 5 and 6 to metering devices 7 and 7*a*, respectively. The design of these metering devices may be seen in FIG. 3. Additional metering devices may be connected to the continuing line 6'. The shielding gas is led from the respective metering devices 7 and 7*a*, via connecting lines 8 and 8*a*, to inlet nozzles 9 and 9*a*, and at that point enters the chamber of the melting furnace 1 above the melt. This is described in detail with reference to FIGS. 4 and 5.

FIG. 2 shows that the shielding gas, $SF_6$, for example, is led through connection 3, and carrier gas, $N_2$, for example, is led through connection 4 in the gas mixing unit 2, both gases to be mixed passing through a respective filter 10 in lines 11 and 12. Inlet pressure monitoring 14 is performed by a central monitoring logic system 13, and the pressure in these inlet lines 11 and 12 is displayed by corresponding manometer systems 15. A pneumatic balanced pressure regulator 16 is used to maintain the pressure of the supplied gases to be mixed at the same level in both feed lines 11 and 12. The gases are maintained at a pressure of at least 5 bar.

The concentration of shielding gas led through the line 11 is adjusted at location 17. A corresponding throttle site 18 is situated in the parallel feed line 12 for the carrier gas, and both pressure lines 11 and 12 lead to a mixing chamber 19 in which both gases respectively exit under pressure from nozzles 20, resulting in a homogeneous mixture in the turbulent flow thus produced. This homogeneous gas mixture is then led via line 22 to a pressure accumulator 21, the pressure of which is controlled by an outlet pressure monitor 23 in the monitoring logic system 13 and in turn is displayed by a manometer 15. In this manner a homogeneous mixed gas is stored in the pressure accumulator 21 independent of the inlet pressure (4-5 bar in this instance), and can then be passed through the continuing line 5 to one or more metering devices 7.

Figure 3:
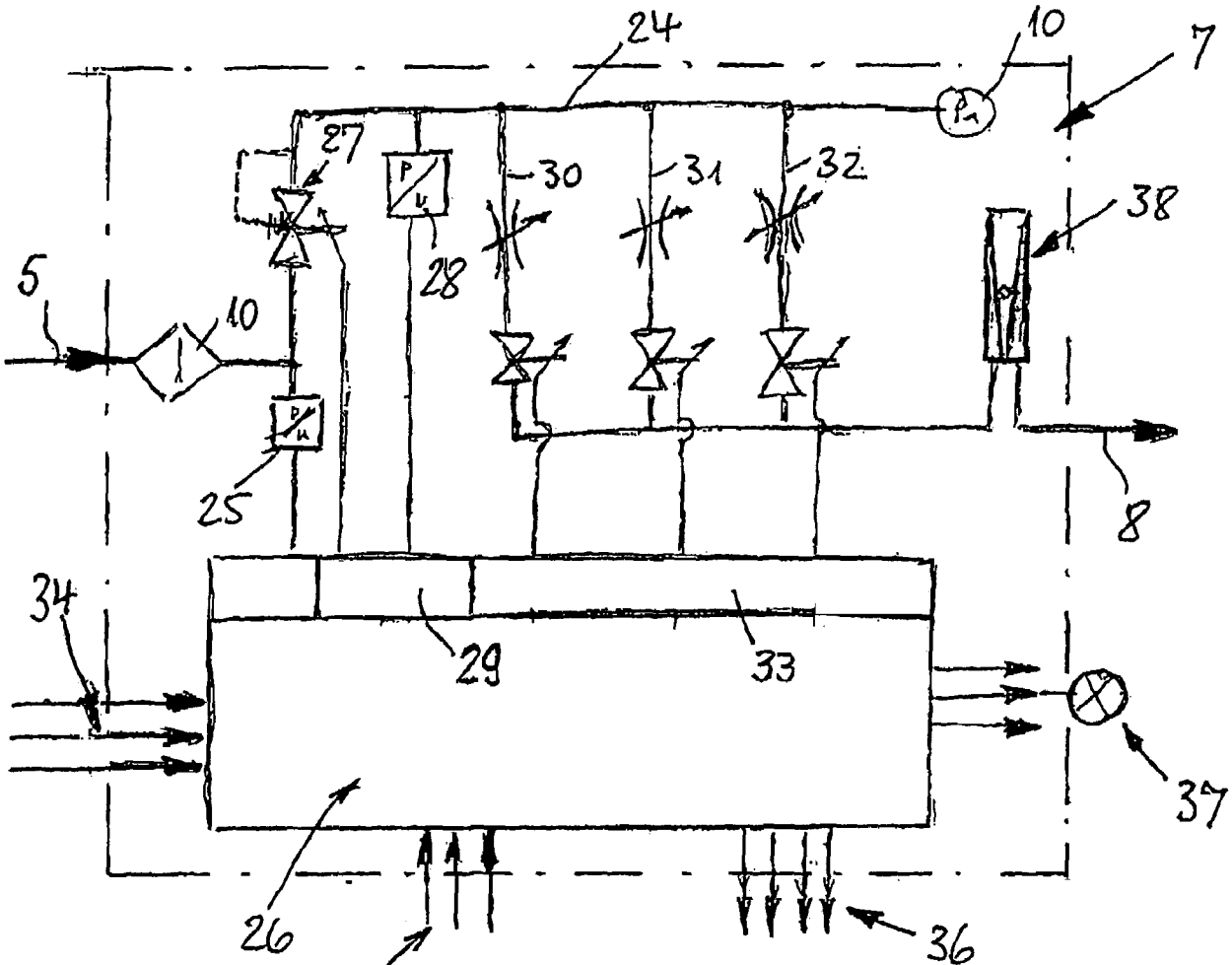
FIG. 3 shows the schematic illustration of a metering device from FIG. 1.

FIG. 3 shows as an exemplary embodiment the metering device 7 of FIG. 1, to which the mixed gas is fed under pressure through line 5.

Here as well, a filter 10 is provided upstream from a continuing line 24, the pressure of which is monitored by the device 25 and a central metering logic system and monitoring device 26, and which is also centrally set to a specified operating pressure, approximately in the range of 1.8 to 3.0 bar, by devices 27 and 28 and the central control 29. This pressure may be displayed by a manometer 15. In the exemplary embodiment, three lines 30, 31 and 32 branch off from line 24, it being optionally possible to connect these lines for passing the gas mixture further to the outlet line 8 so that in each case a different quantity of gas is allowed to flow out. A device 33 for determining the particular operating mode, i.e., for determining the metering, is provided in the central metering logic system 26, whereby in one practical embodiment various sensors may be provided which are actuatable by the operator. These sensors are indicated by the arrows 34.

The central metering logic system is also provided with signal inputs 35 from the pressure die-casting machine and from the melting furnace 1. Corresponding signal outputs to the furnace and to the pressure die-casting machine are indicated by the arrows 36. The central metering logic system also has a device 37 for signaling the operating state and displaying any malfunctions. In the exemplary embodiment, the outlet line 8 is provided with an optical display device 38 for displaying the flow rate.

It may be clearly seen from FIGS. 4 and 5 that the melting furnace 1 shown in the exemplary embodiment has a withdrawal chamber 39 and a storage chamber 40 that are separated by a wall 41. Both chambers contain melt up to level 42, and the space 43 and 43*a* above the melt level is impinged on by the shielding gas mixture. The melt withdrawal device 44—a heat chamber pressure die-casting machine—is situated in the withdrawal chamber 39 in a known manner. Pressure lines 8 and 8*a*, which lead the shielding gas mixture to inlet nozzles 9 and 9*a*, respectively, in this instance are associated with withdrawal chamber 39 (pressure line 8) and melt chamber 40 (pressure line 8*a*). The inlet nozzles 9 for the withdrawal, as shown in FIG. 5, are positioned upstream from the melt withdrawal device 44 in such a way that the gas mixture, which is exiting under pressure and expanding, passes in a flow around the melt withdrawal device 44 to the cleaning opening 45 situated above the withdrawal chamber 39, thus forming an unavoidable leakage point in the chamber 43. Through the configuration of the pressure nozzles and the geometric distribution of these nozzles 9, which are matched to the geometry of the withdrawal chamber, uniform flow in the space 43 is achieved, thus making it possible to avoid concentration shadows or localized excessive concentrations of the shielding gas.

The same applies for the storage chamber 40, whose space 43*a* situated above the melt level 42 is impinged on by the pressure nozzles 9*a*, which in this instance are laterally situated at a greater distance from one another in space 43*a* on the side that is opposite from the cleaning and charge opening 46. In this manner, as indicated by arrows 47 in each case, uniform flow is also achieved in the space 43*a*, which, together with the selected pressure impingement through the inlet nozzles 9, 9*a*, provides a uniform shielding gas concentration above the melt level.

Figure 6:
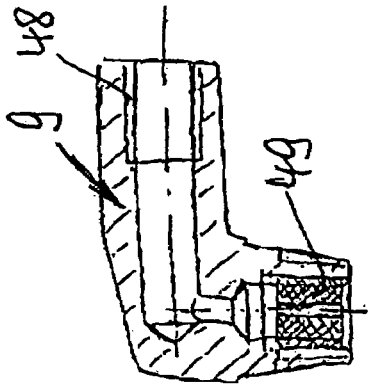
FIG. 6 shows an enlarged view of one of the inlet nozzles, provided for the shielding gas impingement, from FIGS. 4 and 5.

FIG. 6 shows as an example of one of these pressure inlet nozzles 9, which is provided with a screw thread 48 for attachment to corresponding pressure lines, and with a throttle 49 or orifice, downstream from which the gas flowing out under pressure undergoes atomization, thereby providing turbulent homogenization for a uniform distribution in spaces 43 and 43*a*.

Of course, shielding gas impingement according to the invention is also possible for other types of furnaces, such as single-chamber furnaces, for example, or for furnaces that are not used for heat chamber pressure die-casting machines. The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A shielding gas device for pressure die-casting machines, comprising:

a plurality of inlet nozzles, the inlet nozzles being configured to introduce a shielding gas mixture into a melting furnace;

a container, the container being configured to receive a mixture of individual shielding gas components from a plurality of gas sources; and a metering device connected between the container and the inlet nozzles for metering of flow of the shielding gas mixture into the furnace wherein the container is a pressure accumulator, and the metering device is configured to maintain a shielding gas mixture operating pressure at the inlet nozzles which is equal to or less than a pressure in the container, while maintaining the operating pressure high enough to atomize the shielding gas mixture downstream from the inlet nozzles.

2. The shielding gas device according to claim 1, wherein the at least one metering device meters the shielding gas mixture continuously or discontinuously.

3. The shielding gas device according to claim 1, wherein the inlet nozzles are distributed on the melting furnace in such a way that rapid and uniform distribution of the shielding gas mixture is achieved.

4. The shielding gas device according to claim 3, wherein the inlet nozzles are placed on the melting furnace in such a way that gas flows towards leakage points from the furnace.

5. The shielding gas device according to claim 3, the inlet nozzles are configured in such a way that they are protected from being wetted by a melted material in the furnace.

6. The shielding gas device according to claim 1, wherein the operating pressure is adapted to the type of inlet nozzles.

7. The shielding gas device according to claim 6, wherein the operating pressure is regulated and monitored, and a signal device is activated when deviations from a desired operating pressure are detected.

8. The shielding gas device according to claim 6, wherein multiple metering devices for different furnace sections or for different furnaces are connected in parallel and are fed by the container.

9. The shielding gas device according to claim 8, wherein each metering unit is provided with a device for adjusting a flow quantity of metered shielding gas mixture.

10. The shielding gas device according to claim 9, wherein an operating mode sensor is associated with each metering unit for determining the metered quantity.

11. The shielding gas device according to claim 6, wherein each metering unit is provided with a control logic system that receives the signals concerning the furnace status.

12. The shielding gas device according to claim 1, further comprising a mixing device having a mixing chamber in which the gases forming the shielding gas mixture are combined under pressure, wherein the mixing device is upstream of the container.

13. The shielding gas device according to claim 12, wherein pressure nozzles for supplying the gases to be mixed are provided on the mixing chamber.

14. The shielding gas device according to claim 13, further comprising a device for monitoring a pressure in a connecting line between the mixing chamber and the container.

15. The shielding gas device according to claim 13, further comprising a pressure regulating device for maintaining equal pressure among gas feed lines leading to the mixing chamber.

16. The shielding gas device according to claim 12, wherein pressure regulating devices are associated with the feed lines to the mixing chamber.

17. The shielding gas device according to claim 12, further comprising a gas analyzer associated with the mixing chamber by which the concentration of the gas mixture may be monitored.

18. The shielding gas device according to claim 17, wherein the gas analyzer compares the concentration of the gas mixture in the mixing chamber to a reference mixture, and when there are deviations sends a signal to the mixing device.

* * * * *